US007112118B1

(12) United States Patent
Moeller et al.

(10) Patent No.: US 7,112,118 B1
(45) **Date of Patent: *Sep. 26, 2006**

(54) MECHANICAL GRINDING APPARATUS FOR BLENDING DEFECTS ON TURBINE BLADES AND ASSOCIATED METHOD OF USE

(76) Inventors: Dieter Moeller, 6831 Ross La., Mason, OH (US) 45040; Heinz D. Moeller, 6431 State Route 132, Goshen, OH (US) 45122; David B. Moeller, 1835 Stumpy La., Goshen, OH (US) 45122

( * ) Notice: Subject to any disclaimer, the term of this patent is extended or adjusted under 35 U.S.C. 154(b) by 0 days.

This patent is subject to a terminal disclaimer.

(21) Appl. No.: 11/059,249

(22) Filed: Feb. 16, 2005

Related U.S. Application Data

(63) Continuation-in-part of application No. 10/715,946, filed on Nov. 18, 2003, now Pat. No. 6,899,593.

(51) Int. Cl.
*B24B 49/00* (2006.01)

(52) U.S. Cl. ..... 451/6; 451/356

(58) Field of Classification Search ..... 451/294, 451/6, 359, 356; 408/16; 409/143; 359/507; 385/117; 29/33 T, 558
See application file for complete search history.

(56) References Cited

U.S. PATENT DOCUMENTS 4,078,864 A 3/1978 Howell
4,577,388 A 3/1986 Wood
4,659,195 A 4/1987 D'Amelio et al.
4,701,988 A 10/1987 Wood
4,784,463 A 11/1988 Miyazaki
5,102,221 A 4/1992 Desgranges et al.
5,155,941 A 10/1992 Takahashi et al.
5,349,940 A 9/1994 Takahashi et al.
5,349,941 A 9/1994 Hori
5,475,485 A 12/1995 Diener
5,644,394 A 7/1997 Owens
5,655,955 A 8/1997 Nagel et al.
5,803,680 A 9/1998 Diener
6,012,973 A 1/2000 Nagel
6,302,625 B1 10/2001 Carey et al.
6,899,593 B1 * 5/2005 Moeller et al. ..... 451/6

* cited by examiner

*Primary Examiner*—Jacob K. Ackun, Jr.
(74) *Attorney, Agent, or Firm*—Wood, Herron & Evans, LLP

(57) ABSTRACT

A grinding apparatus for use with an endoscope for viewing and blending defects on a turbine engine blade is provided. In one preferred embodiment a mechanical driver causes a grinding head on the end of a grinding tool to reciprocate at a predetermined speed. The position of the grinding head is fixed via the operator via a trigger on the grinding tool which articulates an outer portion of a support tube of the grinding tool.

18 Claims, 4 Drawing Sheets

MECHANICAL GRINDING APPARATUS FOR BLENDING DEFECTS ON TURBINE BLADES AND ASSOCIATED METHOD OF USE

CROSS-REFERENCE TO RELATED APPLICATIONS

This patent application is a continuation-in-part of U.S. patent application Ser. No. 10/715,946 filed Nov. 18, 2003, now U.S. Pat. No. 6,899,593 entitled "Grinding Apparatus for Blending Defects on Turbine Blades and Associated Method of Use", which is fully incorporated by reference herein.

FIELD OF THE INVENTION

The present invention relates to apparatus for blending defects on turbine blades such as, for example, nicks and notches. More particularly, this invention relates to a grinding apparatus for blending defects on turbine blades using an endoscope to view the defects through observation ports in an engine casing.

BACKGROUND OF THE INVENTION

Conventional gas turbine engines, such as those used in aircraft, are enclosed in an engine casing and include a plurality of turbine blades secured to a drum. Such gas turbine engines, typically mounted on the wing of an aircraft, are frequently damaged by foreign objects, such as sand particles, stones, or other objects ingested by the engine during takeoff. These foreign objects ingested by the air turbine engine often cause generally V-shaped nicks or chips on impact along the leading edge of the affected turbine blades. The process of replacing a turbine blade is very expensive, so repair in place is desirable when compared to replacement.

In order to prevent such notches or nicks from becoming more pronounced and potentially cracking the turbine blade, it is desirable to detect the nicks or notches early and, if possible, repair or blend the defects in the turbine blades. In general the term blending is used in the art for the process of smoothing a V-shaped notch or nick into a more U-shaped configuration.

The detection process involves a visual inspection of each turbine blade through a borescope or endoscope passed through observation ports or holes in the engine casing. The borescope, a fiber optic cable connected to a light source, is inserted through borescope openings within the engine case and into the engine. The small borescope openings are disposed throughout the engine case. If a turbine blade having excessive damage is observed, the engine must be removed from the wing of the aircraft, and then disassembled to expose the damaged blade. Only then can the blade be accessed and repaired or replaced. This procedure is time-consuming and extremely expensive. Consequently, more practical techniques for repairing or blending notches or defects on an aircraft turbine blade have been developed. For purposes of the present document, the word "endoscope" may be interpreted to include rigid borescopes, flexible fiber optic borescopes and videoscopes or any similar device.

One type of apparatus used to blend defects on turbine blades in the manner described above uses a rotary grinding head or tool located at the end of a blending tool. The tool may be passed through the observation ports in the engine casing. U.S. Pat. Nos. 5,644,394; 5,803,680 and 5,475,485 disclose such apparatus. One difficulty with tools using rotary heads is that the rotational speed required to blend the defect is so high that the surface of the turbine blade becomes very hot due to friction. Because most turbine blades are made of titanium, the integrity of the titanium may be compromised at high temperatures. The titanium metal may actually melt or deform at high enough temperatures.

An alternative to a tool which rotates a grinding head is disclosed in U.S. Pat. No. 5,102,221. This patent discloses an apparatus for repairing or blending defects on a turbine blade using a reciprocating motion, as opposed to a rotary motion. Again, this apparatus is used with an endoscope. The apparatus disclosed in this patent is difficult to use and subject to failure due to the configuration and operation of the apparatus. Therefore, there is a need for a grinding apparatus to blend defects on turbine blades which is user-friendly and utilizes a reciprocating motion, as opposed to a rotary motion.

SUMMARY OF THE INVENTION

One preferred embodiment of the present invention comprises a grinding apparatus including two principal components: an endoscope and a grinding tool operatively coupled to the endoscope. Any commercially available endoscope may be use with the present invention. One type of commercially available endoscope which has proven to work satisfactorily with the present invention is a PXLM415 VideoProbe system from Everest Imaging and may be ordered at www.everestvit.com.

In one preferred embodiment, the grinding tool is coupled to a compressed air supply via an air supply line. Air pulses provided by the air supply reciprocate a grinding head operatively coupled to the grinding tool. In another preferred embodiment, fluid is transported to the grinding tool via a supply line and functions to reciprocate the grinding head. In yet another preferred embodiment, a motorized driver is coupled to the grinding head and upon being activated mechanically reciprocates the grinding head.

The grinding tool is adapted to be used with an endoscope for blending a defect on a turbine blade inside a casing. The grinding tool comprises a base unit having a base, a handle extending downwardly from the base proximate the rear of the base, and a trigger located in front of the handle and extending downwardly from the base also. Although one configuration of base unit is illustrated, the base unit may assume numerous other configurations without departing from the spirit of this invention.

The grinding tool further comprises a support tube extending forwardly from the base unit and being sized to fit through an observation port in the casing. The support tube in one preferred embodiment has an opening at the forward end of the support tube, so that an articulated end of the endoscope may pass through the support tube and out the opening in the support tube.

In one preferred embodiment, an extension member is hingedly connected to the forward end of the support tube and operatively coupled to the trigger. Because the extension member is mechanically connected to the trigger, an operator may change the position of the extension member by moving the trigger, thereby flexing the hinge. The extension member has a hollow interior in which is located a piston and a spring surrounding a portion of the piston. No matter what the position of the extension member, air passes through the support tube and hinge to reciprocate the piston in the extension member.

A cylindrical grinding head is coupled to a forward end of the piston and upon activation reciprocates at a predetermined speed. Pulses of air supplied by the source of compressed air and pushed through an air supply line to the grinding tool push the piston against the bias of the spring in the extension member, causing the spring to compress. When the burst or pulse of air is exhausted, the spring forces the piston back to its original position. In this manner, the spring goes through a cycle of compression and noncompression as the piston reciprocates in response to the air pulses. Other means of reciprocating the grinding head may be used if desired.

In another preferred embodiment of the present invention, the support tube comprises a first linear portion having an opening therein so that the forward end of the endoscope can pass through the opening in the support tube and enable the operator to view the turbine blade. The support tube further comprises a second linear portion hingedly connected to the first portion and operatively coupled to the trigger so that movement of the trigger causes movement of the second portion of the support tube. A piston and spring arrangement like the one described above are located in the second movable portion of the support tube. A reciprocating grinding head is coupled to the piston.

Although the present invention preferably has a hinge incorporated into the support tube, it is within the contemplation of the present invention that the support tube lack a hinge. In such an embodiment, the support tube is preferably bent but may assume any desired configuration. In this situation, a second portion of the support tube is fixed at an angle, preferably an acute angle, relative to the first linear portion of the support tube.

In use, a defect on a turbine blade may be blended or smoothed using the grinding apparatus of the present invention. The first step in utilizing the grinding apparatus of the present invention is to couple a commercially available endoscope to the grinding tool. This is accomplished by passing a portion of the endoscope, including the lens end, through the base of the grinding tool, through the support tube of the grinding tool and out an opening in the support tube. When coupled to a light source, the endoscope enables the operator to view inside the engine casing.

Then the support tube of the grinding tool, with the endoscope passing therethrough, is passed through an observation port or hole in the engine casing. Using the endoscope, the operator locates a defect on the turbine blade by visual scanning. The operator then uses the trigger on the grinding tool to position the grinding head proximate to the defect on the turbine blade. Then a driver is activated to supply air pulses to the grinding tool via the air supply line. The air pulses pass through the support tube of the grinding tool and contact the piston, causing the piston and grinding head of the grinding tool to reciprocate at a desired speed. The frequency of the air pulses may be varied as desired by any known means to change the speed of reciprocation of the grinding head. If desired, the air pulses may be used to rotate rather than reciprocate the grinding head.

In another preferred embodiment of the present invention, fluid is used to reciprocate the grinding head. The fluid is provided via a fluid supply and passed through a supply tube to the grinding tool to reciprocate the grinding head. Any means such as a motorized pump may be used to supply fluid to the grinding tool.

In another preferred embodiment of the present invention, a wire is used to reciprocate the grinding head. The wire is operatively coupled at one end to a motorized driver such as a variable speed motor, passed through the grinding tool and coupled to a piston which is secured to the grinding head. Activation of the motorized driver reciprocates the piston and grinding head. Any means such as a cam driven by a motor may be used to reciprocate the wire operatively coupled to the piston.

Without departing from the present invention, the trigger may be omitted from the base unit of the grinding tool. In place of a trigger a knob may be incorporated into the base unit. The knob may be twisted or pulled to mechanically change the position of the end portion of the support tube or extension member so that the grinding head is positioned proximate the defect on the turbine blade. Other means of mechanically moving the end portion of the support tube or extension member may be used, if desired.

DETAILED DESCRIPTION OF THE INVENTION

Figures 1, 1A:
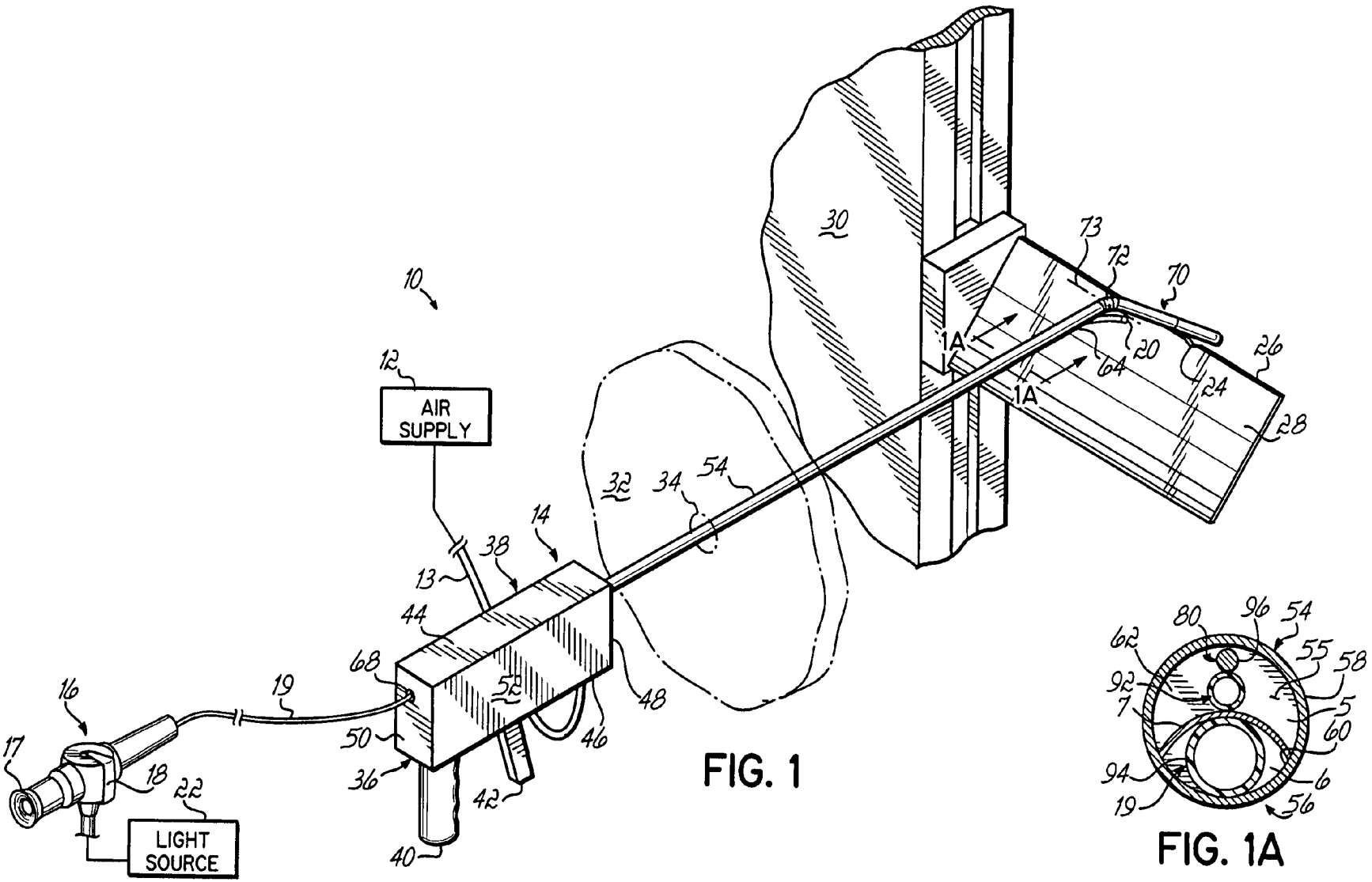
FIG. 1 is a perspective view of the grinding apparatus of the present invention used in conjunction with an endoscope.
FIG. 1A is a cross-sectional view taken along the line 1A–1A of FIG. 1.

Referring to the drawings and particularly to FIG. 1, there is illustrated a grinding apparatus 10 including an air supply 12, an air supply line 13 and a grinding tool 14 for use with an endoscope 16. The endoscope 16 has an eyepiece 17 at the end of a tube 19 and an articulated lens end 20 moveable via movement of a lever 18 on the eyepiece 17, as is known in the art. Any other sort of viewer such as a video viewer may be used in place of the eyepiece 17 to view or display data. Preferably, the endoscope 16 is used with a light source 22. Although one type of endoscope is illustrated and described, the grinding apparatus 10 may be used with many different types of endoscopes.

The grinding apparatus 10 of the present invention is used for blending or retouching a defect, notch or nick 24 along the leading edge 26 of a turbine blade 28 secured to a drum 30 (only partially shown) in a manner known in the art. The drum 30 and turbine blades 28 attached thereto are mounting in an engine casing 32 having a plurality of observation ports 34, as is known in the art.

As best illustrated in FIG. 1, the air supply 12 may include any known means to provide air pulses and push them through the air supply line 13 to the grinding tool 14.

As best illustrated in FIG. 1, the grinding tool 14 comprises a base unit 36 including a base 38, a handle 40 and a trigger 42. The base 38 is preferably made of metal but may be made of any material. The base 38 has a top wall 44, a bottom wall 46, a front wall 48, a rear wall 50 and a pair of opposed side walls 52. The handle 40 extends downwardly from the bottom wall 46 of the base 38 proximate the rear wall 50 of the base 38. Similarly, the trigger 42 extends downwardly from the bottom wall 46 of the base 38 in front of the handle 40. Although one configuration of base and base unit are illustrated and described, other configurations of bases and base units may be utilized without departing from the present invention. For example, the handle and/or trigger may be located at a different location. Alternatively, the handle may be omitted and/or the trigger replaced with other apparatus.

Figure 2:
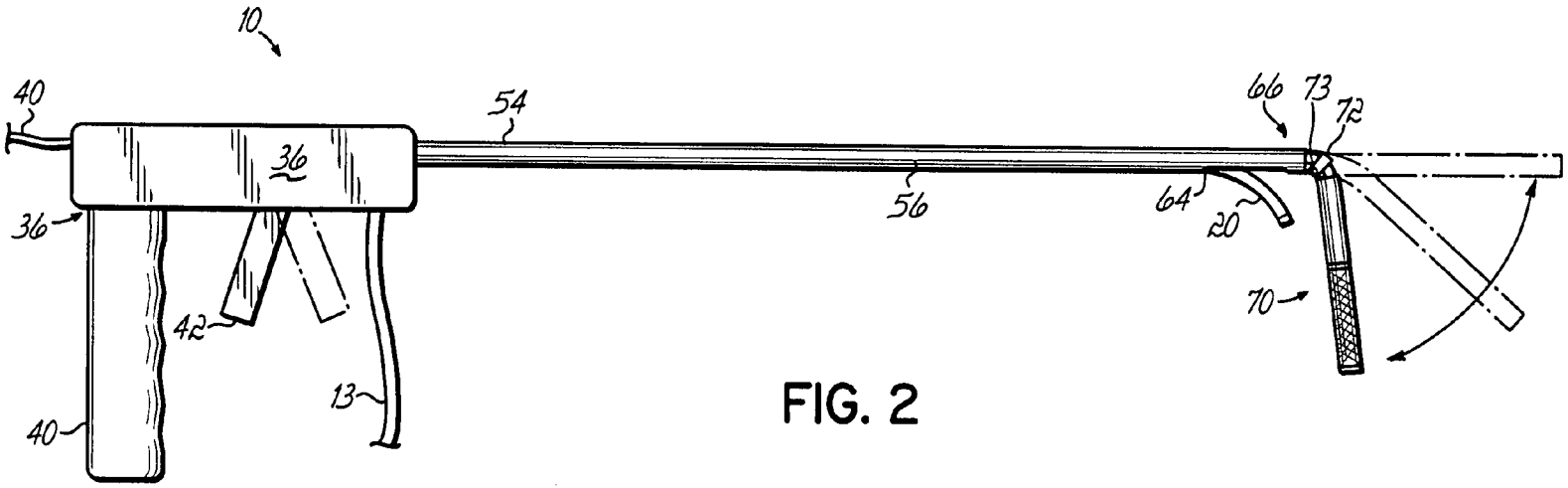
FIG. 2 is a side elevational view of one preferred embodiment of the grinding tool of the present invention.

The grinding tool 14 further comprises a support tube 54 extending forwardly from the base 38. As shown in FIG. 1A, the support tube 54 has a circular wall 56 having an outer surface 58 and an inner surface 60. The interior 62 of the support tube 54 is hollow and divided into an upper portion 5 and a lower portion 6 by a divider or guide 7. As shown in FIG. 1A, the endoscope tube 19 passes through the lower portion 6 as shown in FIG. 1A. As illustrated in FIG. 2, the support tube wall 56 has an opening 64 at a forward end 66 of the support tube 54. The articulating end 20 of the endoscope 16 protrudes through this opening 64 in a manner shown in FIG. 1 to enable the operator to view inside the engine casing wall 32. To couple or join the endoscope 16 with the grinding tool 14 of the present invention, the articulating lens end 20 of the endoscope 16 is passed through a hole 68 in the rear wall 50 of the base 38, through the base 38 and then through the lower portion 6 of the support tube 54 before exiting the opening 64 in the support tube wall 56.

Figure 3:
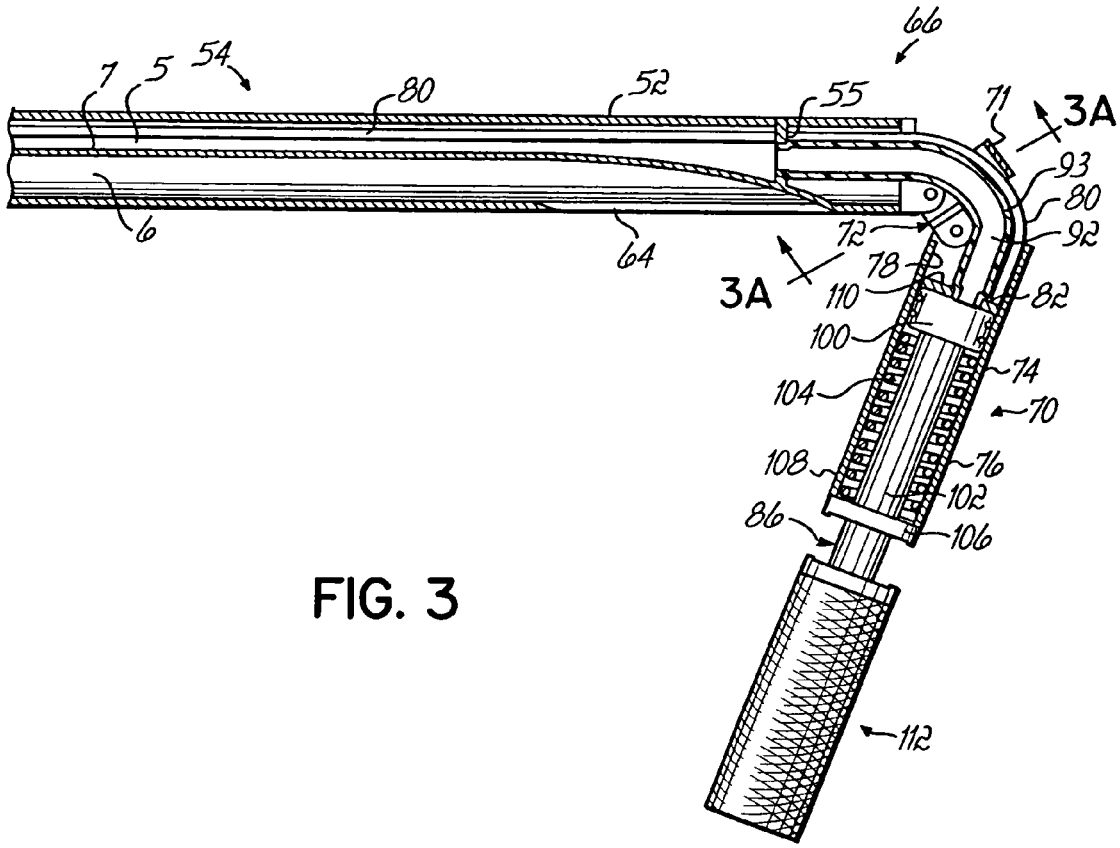
FIG. 3 is a side elevational view partially in cross section of a portion of the grinding tool of FIG. 2.

In a first preferred embodiment, an extension member 70 is coupled or joined to the support tube 54 via hinge 72. The hinge 72 pivots about an axis 73 and is coupled or joined to the support tube 54 and the extension member 70. See FIG. 1. FIG. 3 illustrates in detail one form of hinge 72; however, any other type of suitable hinge may be used in accordance with the present invention.

In one preferred embodiment of the present invention, the extension member 70 is preferably a linear piece of tubing, made of metal, plastic or any other suitable material. As seen in FIG. 3, the extension member 70 has a circular wall 74 having an outer surface 76 and an inner surface 78. However, the extension member 70 may assume other configurations without departing from the spirit of the present invention. If desired, the extension member 70 may be considered a second portion of the support tube hingedly connected to a first linear portion of the support tube. If desired, the hinge may be omitted and the second portion of the support tube fixed in position relative to the first portion of the support tube.

The extension member 70 is operatively coupled to the trigger 42 so that the operator may move the extension member 70 by moving the trigger 42. In one preferred embodiment, at least one wire 80 (shown in cross section in FIG. 1A) is secured at one end 82 to the extension member 70 via welding or any other suitable method and secured at the other end (not shown) to the trigger 42. See FIG. 3. The wire 80 extends the length of the support tube 54 on the inside thereof. Although this is one mechanical way of coupling the trigger 42 and extension member 70 so that the extension member 70 may be mechanically moved to its desired position, other methods of coupling the trigger and extension member may be utilized. As shown in FIG. 2, the trigger 42 may be moved from a first position shown in dashed lines to a second position shown in solid lines which causes the extension member 70 to move from an extended or first position shown in dashed lines in FIG. 2 to a bent or second position shown in solid lines in FIG. 2.

Figure 3A:
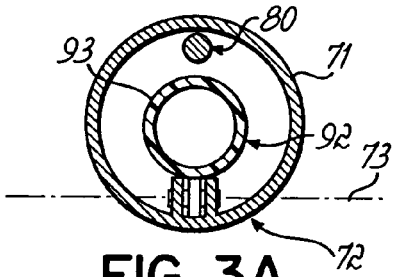
FIG. 3A is a cross-sectional view taken along the line 3A–3A of FIG. 3.

As shown in FIG. 3A, the hinge 72 has an outer wall 71 inside which wire 80 passes. In addition, an air tube 92 passes through the hinge 72 inside the hinge outer wall 71. The air tube 92 is a flexible piece of tubing having an outer tube wall 93, preferably made of plastic, which extends from an air stop 55 in the support tube 54 to a piston 86 in the extension member 70. See FIGS. 3 and 3A.

As shown in FIG. 1A, the support tube 54 has an air stop 55 at the forward end 66 of the support tube 54 which reduces the diameter through which the air flows as air passes through the hinge 72. The air stop 55 has an opening 94 through which the air tube 92 passes and another opening 96 through which the wire 80 passes. See FIG. 1A. If desired, two or more wires or other structures may be used in accordance with the present invention.

As shown in FIG. 3, a piston 86 is located at least partially inside the extension member 70 and moveable therein in reaction to the pulses of air from the air supply 12. The piston 86 has a base portion 100 and an finger portion 102 extending forwardly from the base portion 100. The base portion 100 of the piston 86 has a diameter approximately equal to the inner diameter of the extension member 70 so that air may not get through the extension member 70 without moving the piston 86. A spring 104 surrounds the finger portion 102 of the piston 86 inside the extension member 70 as shown in FIG. 3. The spring 104 extends between a stop 106 at the forward end 108 of the extension member 70 and the base portion 100 of the piston 86. When a pulse of air passes through the tube 92, the air exerts force or pressure on the base portion 100 of the piston 86, moving the base portion 100 of the piston 86 forwardly against the bias or force of the spring 104, thereby compressing the spring 104 against the stop 106 in the extension member 70. Once the pressure from the air pulse is relaxed or extinguished, the spring 104 pushes the piston 86 back to its original position in which the base portion 100 of the piston 86 abuts a stop 110 in the extension member 70. In this manner the spring 104 cycles between a compressed position and a relaxed position in response to the air pulses generated in the air supply 12 and passed through the air supply line 13 to the grinding tool 14.

A grinding head 112 is coupled to the finger portion 102 of the piston 86 outside of the extension member 70 in a manner shown in detail in FIG. 3. The grinding head 112 is preferably cylindrical but may be other shapes or configurations. Any suitable means of securing the grinding head 112 to the finger portion 102 of the piston 86 may be used.

In use, the endoscope 16 is coupled or joined to the grinding tool 14 by passing the lens end 20 of the endoscope 16 through the opening 68 in the base 38 of the endoscope, through the base 38 of the grinding tool 14, through the support tube 54 of the grinding tool 14 and out the opening 64 in the support tube wall 56. A light source 22 is coupled to the endoscope 16 in a manner known in the art either before or after the endoscope 16 is coupled to the grinding tool 14. The operator then passes the support tube 54 of the grinding tool 14 with a portion of the endoscope 16 therethrough through one of the observation ports 34 in the engine casing 32. The operator then uses the endoscope 16 to locate a defect 24 along the leading edge 26 of a turbine blade 28. The operator then positions the grinding head 112 proximate the defect 24 and activates the air supply to provide air pulses to the grinding tool 14. The operator uses the trigger 42 to move the extension member 70 and grinding head 112 via the hinge 72 in the manner described above. The air pulses reciprocate the piston 86 in the extension member 70 of the grinding tool 14. The reciprocation of the piston 86 causes the grinding head 112 to reciprocate because the piston 86 and grinding head 112 are joined together.

Figure 4:
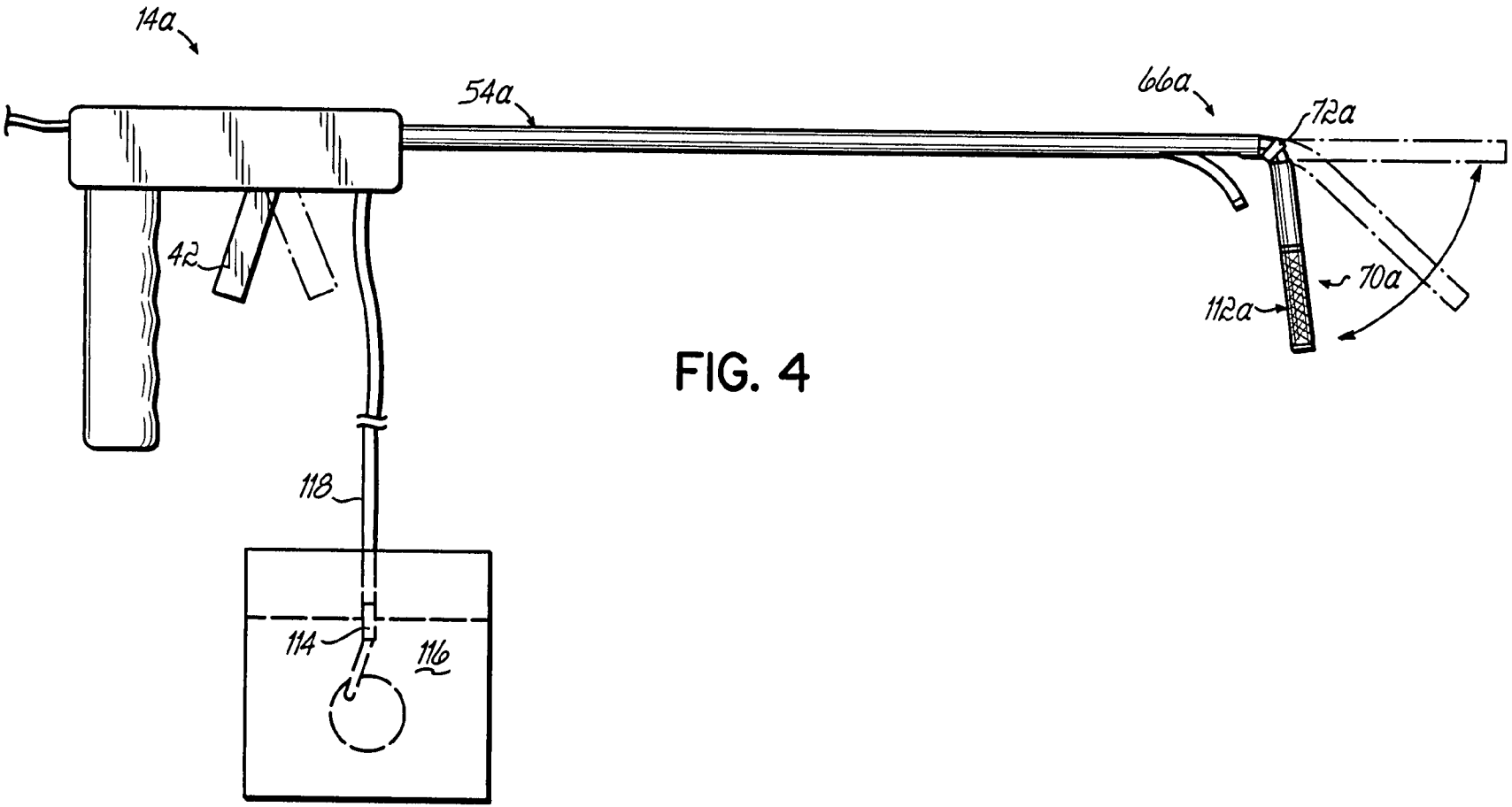
FIG. 4 is a perspective view of an alternative embodiment of grinding apparatus of the present invention used in conjunction with an endoscope.

An alternative preferred embodiment of the present invention is illustrated in FIG. 4. For the sake of simplicity, like numerals will be used to describe like parts but with a letter "a" designation. In this preferred embodiment, fluid is used rather than air to reciprocate a grinding head 112*a* secured to the end of an extension member or portion of a support tube 70*a*. Any method of securing the grinding head 112*a* to the end of the extension member 70*a* may be used. A piston 114 pushes and pulls fluid from a fluid supply 116 through tube 118 to the grinding tool 14*a*. The fluid passes through the support tube 54*a* including hinge 72*a* to a piston (not shown). The back and forth movement of the fluid in the grinding tool 14*a* reciprocates the piston (not shown) to which is connected grinding head 112*a*. In many respects, the grinding tool 14*a* is similar to the grinding tool 14 described above, except fluid rather than air is used to reciprocate the grinding head.

Figure 5:
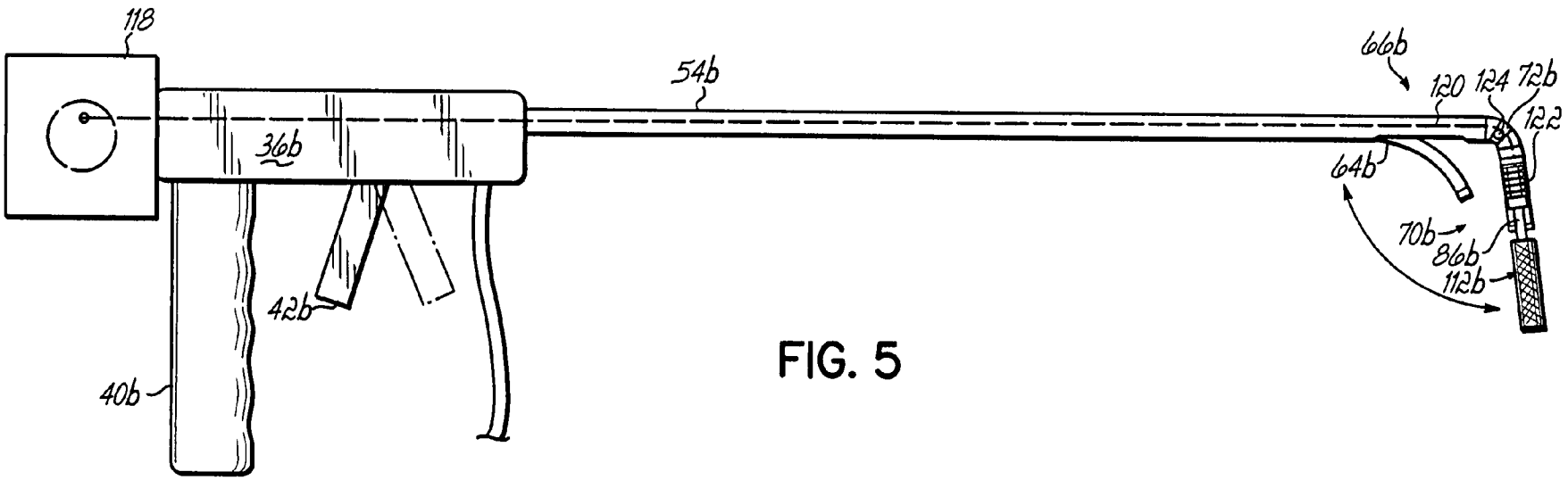
FIG. 5 is a perspective view of another alternative embodiment of grinding apparatus of the present invention for use with an endoscope.

An alternative preferred embodiment of the present invention is illustrated in FIG. 5. For the sake of simplicity, like numerals will be used to describe like parts but with a letter "b" designation. In this embodiment, a mechanical driver for example, a motorized driver, is used rather than air or fluid to reciprocate a grinding head 112*b* secured to a piston 86*b* located at least partially in the extension member 70*b* or portion of a support tube 54*b*. The extension member 70*b* is operatively coupled to the stationary portion of the support tube 54*b* with an articulated hinge 72*b*. See FIG. 5. Any method of securing the grinding head 112*b* to the piston 86*b* may be used such as welding, for example. A motorized driver 118 pulls a wire 120 extending through the support tube 54*b* of the grinding tool 14*a* around a pulley 124 and secured to a piston 86*b* located in extension member 70*b*. If desired, the pulley 124 may be omitted. Although the motorized driver 118 is shown in one location, it may be located elsewhere relative to the base unit 36*b*. Extension member 70*b* is hingedly connected to the support tube 54*b* in any operable manner. A grinding head 112*b* is secured to the piston 86*b* in any suitable manner or fashion. A spring 122 located inside the extension member 70*b* and surrounding a portion of the piston 86*b* pushes the piston 86*b* back outwardly after the tension on the wire 120 is partially relaxed. The back and forth movement of the piston 86*b* due to the motorized driver 118, wire 120 and spring 122 causes the piston 86*b* and grinding head 112*b* to reciprocate. In many respects, the grinding tool 14*b* is similar to the grinding tool 14 described above, except a motorized, mechanical driver in concert with a spring causes the grinding head to reciprocate.

It is to be understood that various changes and modifications may be made to the preferred embodiments discussed above without departing from the scope of the present invention, which is defined by the following claims and equivalents thereof. For example, with any of the embodiments described herein, the grinding head may be rotated rather than reciprocated.

We claim:

1. A grinding tool for use with an endoscope for blending a defect on a turbine blade inside a casing having an observation port, said grinding tool comprising:

a base unit;

a support tube extending forwardly from said base unit and being sized to fit through an observation port;

an extension member connected to said support tube and operatively coupled to said base unit, means incorporated in said base unit to change the position of said extension member;

a piston located at least partially in said extension member; and a grinding head coupled to said piston.

2. The grinding tool of claim 1 wherein said grinding head reciprocates upon activation.

3. The grinding tool of claim 2 further comprising a motorized driver for reciprocating said piston.

4. The grinding tool of claim 1 wherein said support tube has an opening therethrough.

5. The grinding tool of claim 1 further comprising a spring surrounding a portion of said piston.

6. A grinding tool for blending a defect on a turbine blade, said grinding tool comprising:

a base;

a support tube extending forwardly from said base, said support tube having a first portion and a second portion fixed at an angle relative to said first portion; and a reciprocating grinding head coupled to a piston at least partially located in said second portion of said support tube which is activated by a mechanical driver.

7. The grinding tool of claim 6 further comprising a trigger connected to said base, said trigger being operatively coupled to said second portion of said support tube so that movement of said trigger causes movement of said second portion of said support tube.

8. The grinding tool of claim 6 wherein said second portion of said support tube is movable relative to said first portion of said support tube.

9. A grinding tool for use with an endoscope for blending a defect on a turbine blade inside a casing having an observation port, said grinding tool comprising:

a base unit;

a support tube extending forwardly from said base unit and being sized to fit through an observation port in a casing, said support tube having an opening therethrough through which a portion of said endoscope may pass;

an extension member connected to said support tube and operatively coupled to said base unit;

means to change the position of said extension member;

a piston located at least partially in said extension member; and a grinding head coupled to said piston.

10. The grinding tool of claim 9 wherein said piston reciprocates upon activation.

11. The grinding tool of claim 9 wherein said base unit includes a motor.

12. An apparatus for use with an endoscope for blending a defect on a turbine blade located in a casing having an observation port, said apparatus comprising:

a base unit including a motorized driver and a trigger;

a support tube extending forwardly from said base unit, said support tube having an opening therethrough, an endoscope being able to pass through said support tube and out said opening in said support tube;

an extension member connected to said support tube and operatively coupled to said trigger, wherein said trigger is used to change the position of said extension member; and a grinding head coupled to a piston at least partially located in said extension member, wherein said grinding head is reciprocated via said motorized driver.

13. In combination, a grinding tool and an endoscope for blending a defect on a turbine blade inside a casing having an observation port, said combination comprising:

a grinding tool having a base unit including a trigger;

a support tube extending forwardly from said base unit, said support tube having an opening therethrough;

an extension member connected to said support tube and operatively coupled to said trigger, wherein said trigger is used to change the position of said extension member;

a piston located at least partially in said extension member;

a grinding head coupled to said piston; and an endoscope having a portion extending through said support tube of said grinding tool and out said opening in said support tube.

14. The combination of claim 13 further comprising a spring surrounding a portion of said piston.

15. A method of blending a defect on a turbine blade inside a casing having an observation port with a grinding apparatus including a grinding tool and an endoscope, said method comprising:

providing a grinding tool comprising a base, a support tube extending forwardly from said base, said support tube having an opening therethrough, an extension member hingedly connected to said support tube, and a grinding head coupled to a piston located at least partially in said extension member;

passing a portion of said endoscope through said support tube of said grinding tool and out said opening in said support tube;

passing said support tube through an observation port in a casing;

locating a defect on a turbine blade with said endoscope;

positioning said grinding head proximate said defect on said turbine blade; and activating a driver to reciprocate said piston and said grinding head.

16. The method of claim 15 wherein positioning said grinding head proximate said defect on said turbine blade comprises moving said extension member of said grinding tool via a trigger.

17. A method of blending a defect on a turbine blade inside a casing having an observation port with a grinding apparatus including a grinding tool and an endoscope, said method comprising:

providing a grinding tool comprising a support tube extending forwardly from a base, a piston adapted to move in said support tube and a grinding head secured to said piston;

providing an endoscope;

passing said support tube and a portion of said endoscope through said observation port in said casing;

locating a defect on a turbine blade using said endoscope;

positioning said grinding head proximate said defect on said turbine blade; and reciprocating said grinding head via a mechanical driver.

18. The method of claim 17 wherein positioning said grinding head proximate said defect on said turbine blade comprises moving a portion of said support tube of said grinding tool via a trigger on said grinding tool.

* * * * *